US008383574B2

(12) United States Patent
Kotachi et al.

(10) Patent No.: US 8,383,574 B2
(45) Date of Patent: Feb. 26, 2013

(54) PERFUME COMPOSITION

(75) Inventors: Shinji Kotachi, Wakayama (JP); Shinya Nagasawa, Wakayama (JP); Satoshi Ohno, Tokyo (JP)

(73) Assignee: Kao Corporation, Tokyo (JP)

( * ) Notice: Subject to any disclaimer, the term of this patent is extended or adjusted under 35 U.S.C. 154(b) by 123 days.

(21) Appl. No.: 12/921,287

(22) PCT Filed: Mar. 2, 2009

(86) PCT No.: PCT/JP2009/053887

§ 371 (c)(1), (2), (4) Date: Nov. 16, 2010

(87) PCT Pub. No.: WO2009/110433

PCT Pub. Date: Sep. 11, 2009

(65) Prior Publication Data

US 2011/0071070 A1 Mar. 24, 2011

(30) Foreign Application Priority Data

Mar. 6, 2008 (JP) ..... 2008-056542

(51) Int. Cl.
*A61Q 13/00* (2006.01)

(52) U.S. Cl. ..... 512/24

(58) Field of Classification Search ..... 512/24
See application file for complete search history.

(56) References Cited

U.S. PATENT DOCUMENTS 5,698,253 A 12/1997 Dekker et al.

FOREIGN PATENT DOCUMENTS

| | | |
|---|---|---|
| JP | 8 104666 | 4/1996 |
| JP | 8 507314 | 8/1996 |
| WO | WO 2006/030268 A1 | 3/2006 |

OTHER PUBLICATIONS

13C Nuclear Magnetic Resonance Studies. 29. 13C Spectra of Some Alicyclic Methyl Esters, Department of Chemistry, University of Western Ontario, London, Ontario, Jan. 29, 1973.*

Pirozhkov, et al., "Carbonylation of Terpenes," Izvestiya Akademii Nauk SSSR, Seriya Khimicheskaya, vol. 4, pp. 841-847, (1979).

Into, Gen'ichi, "Gosei Koryo Kagaku to Shohin Chishiki," 1st Edition, 1st Print, The Chemical Daily Co., Ltd., pp. 836-838, (1996).

International Search Report issued Mar. 24, 2009 in PCT/JP09/053887 filed Mar. 2, 2009.

Extended European Search Report issued Jul. 26, 2011, in Patent Application No. 09716480.0.

* cited by examiner

*Primary Examiner* — Ling Choi
*Assistant Examiner* — Lanee Reuther
(74) *Attorney, Agent, or Firm* — Oblon, Spivak, McClelland, Maier & Neustadt, L.L.P.

(57) ABSTRACT

The present invention relates to a perfume composition as a raw material of fruity perfumes which has a conventionally unknown peculiar fresh, woody, floral, grassy-leafy nuance and is capable of harmonizing with various perfumes to provide perfume preparations having a more sophisticated odor or scent. The perfume composition of the present invention includes a compound represented by the general formula (I):

(I)

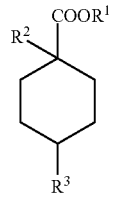

wherein $R^1$ and $R^2$ are each independently a hydrocarbon group having 1 to 4 carbon atoms; and R3 is a hydrocarbon group having 2 to 4 carbon atoms.

16 Claims, No Drawings

PERFUME COMPOSITION

FIELD OF THE INVENTION

The present application is a National Stage (371) of PCT/JP2009/053887, filed Mar. 2, 2009, and claims priority to JP 2008-056542, filed Mar. 6, 2008.

BACKGROUND OF THE INVENTION

Patent Document 1 discloses 4-isopropyl cyclohexanecarboxylate which has been conventionally used in the application fields of perfumes, but does not describe an odor of the ester. As described in Patent Document 2, it is known that 1,4-dimethyl cyclohexanecarboxylate which is a cyclohexanecarboxylic acid ester having alkyl substituent groups bonded to not only the 4-position but also the 1-position thereof, respectively, is a useful perfume material. In Patent Document 2, it is further described that the 1,4-dimethyl cyclohexanecarboxylate has a fresh herbal odor together with a green and floral note of scent.

Also, Non-Patent Document 1 discloses ethyl 4-alkyl-1-methyl-cyclohexanecarboxylates, and Non-Patent Document 2 discloses ethyl 4-isopropyl-1-methyl-cyclohexanecarboxylate. However, none of the Non-Patent Documents describe odors or scents of these compounds.

Patent Document 1: JP-A 8-104666

Patent Document 2: JP-A 10-245584

Non-Patent Document 1: "Canadian Journal of Chemistry", Vol. 74, pp. 2487-2502 (1996)

Non-Patent Document 2: "Izvestiya Akademii Nauk SSSR, Seriya Khimicheskaya", Vol. 4, pp. 841-847 (1979); ("Chemical Abstract", Vol. 91, No. 70749)

SUMMARY OF THE INVENTION

The present invention relates to a perfume composition as a fruity perfume material which has a conventionally unknown peculiar fresh woody, floral or grassy-leafy nuance and is capable of harmonizing with various perfumes to provide perfume preparations having a more sophisticated odor or scent.

As a result of extensive researches and studies on odors of various cyclohexanecarboxylic acid esters having hydrocarbon groups bonded to the 1-position and the 4-position thereof, respectively, in view of the above conventional problems, the present inventors have found that those cyclohexanecarboxylic acid esters in which a hydrocarbon group having 2 to 4 carbon atoms and a hydrocarbon group having 1 to 4 carbon atoms are bonded to the 4-position and the 1-position of a cyclohexane ring thereof, respectively, exhibit a fruity odor having a peculiar fresh woody, floral or grassy-leafy nuance, and can solve the problems.

Thus, the present invention relates to a perfume composition containing a compound represented by the following general formula (I):

(I)

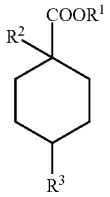

wherein $R^1$ and $R^2$ are each independently a hydrocarbon group having 1 to 4 carbon atoms; and $R^3$ is a hydrocarbon group having 2 to 4 carbon atoms.

In accordance with the present invention, there is provided a perfume composition which contains an alicyclic ester represented by the above general formula (I) as a useful aromatizing ingredient for toiletry goods, etc., and is thereby imparted with a sophisticated note of scent.

DETAILED DESCRIPTION OF THE INVENTION

[Alicyclic Ester of Present Invention]

The perfume composition of the present invention contains an alicyclic ester represented by the following general formula (I) (hereinafter occasionally referred to merely as an "alicyclic ester of the present invention"):

(I)

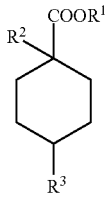

In the general formula (I), $R^1$ is a hydrocarbon group having 1 to 4 carbon atoms. More specifically, as the suitable hydrocarbon group represented by $R^1$, there may be mentioned an alkyl group having 1 to 4 carbon atoms, an alkenyl group having 1 to 4 carbon atoms and an alkynyl group having 1 to 4 carbon atoms. Specific examples of the hydrocarbon group represented by $R^1$ include alkyl groups such as methyl, ethyl, propyl, isopropyl, butyl, isobutyl, sec-butyl and tert-butyl; alkenyl groups such as vinyl, allyl, 1-butenyl and 1-methyl vinyl; and alkynyl groups such as ethynyl and 2-propynyl.

Among these groups as $R^1$, from the viewpoint of a good note of scent, preferred are alkyl groups having 1 to 4 carbon atoms, more preferred are methyl, ethyl, propyl, isopropyl, butyl, isobutyl and sec-butyl, still more preferred are methyl, ethyl, propyl and isopropyl, and especially preferred are methyl and ethyl.

In the general formula (I), $R^2$ is a hydrocarbon group having 1 to 4 carbon atoms. More specifically, as the suitable hydrocarbon group represented by $R^2$, there may be mentioned an alkyl group having 1 to 4 carbon atoms, an alkenyl group having 1 to 4 carbon atoms and an alkynyl group having 1 to 4 carbon atoms. Specific examples of the hydrocarbon group represented by $R^2$ include alkyl groups such as methyl, ethyl, propyl, isopropyl, butyl, isobutyl, sec-butyl and tert-butyl; alkenyl groups such as vinyl, allyl, 1-butenyl and 1-methyl vinyl; and alkynyl groups such as ethynyl and 2-propynyl.

Among these groups as $R^2$, from the viewpoint of a good note of scent, preferred are alkyl groups having 1 to 4 carbon atoms and alkenyl groups having 1 to 4 carbon atoms, more preferred are methyl, ethyl, propyl, isopropyl, vinyl and allyl, still more preferred are methyl, ethyl, propyl, vinyl and allyl, and especially preferred are methyl and ethyl.

In the general formula (I), $R^3$ is a hydrocarbon group having 2 to 4 carbon atoms. More specifically, as the suitable hydrocarbon group represented by $R^3$, there may be mentioned an alkyl group having 2 to 4 carbon atoms, an alkenyl group having 2 to 4 carbon atoms and an alkynyl group having 2 to 4 carbon atoms. Specific examples of the hydrocarbon group represented by $R^3$ include alkyl groups such as ethyl, propyl, isopropyl, butyl, isobutyl, sec-butyl and tort-butyl; alkenyl groups such as vinyl, allyl, 1-butenyl and 1-methyl vinyl; and alkynyl groups such as ethynyl and 2-propynyl.

Among these groups as $R^3$, from the viewpoint of a good note of scent, preferred are alkyl groups having 1 to 4 carbon atoms and alkenyl groups having 1 to 4 carbon atoms, more preferred are ethyl, propyl, isopropyl, butyl, isobutyl, sec-butyl, tert-butyl, allyl and 1-methyl vinyl, still more preferred are propyl, isopropyl, butyl, isobutyl, sec-butyl and 1-methyl vinyl, and especially preferred is isopropyl.

The compound represented by the general formula (I) which is contained in the perfume composition of the present invention may be in the form of a mixture containing a cis isomer having a cis structure in which the $COOR^1$ group bonded to the 1-position and the hydrocarbon group bonded to the 4-position are sterically present on the same side relative to a cyclohexane ring thereof, and a trans isomer having a trans structure in which the $COOR^1$ group bonded to the 1-position and the hydrocarbon group bonded to the 4-position are sterically present on the different sides relative to a cyclohexane ring thereof. According to the present invention, since the higher content of the trans isomer having a stronger sweetly fruity sense leads to a higher effect in the resulting perfume preparation, the contents of the cis and trans isomers in the mixture are controlled such that the mass ratio of the cis isomer to the trans isomer (cis isomer:trans isomer) is preferably from 99:1 to 0:100 and more preferably from 98:2 to 0:100. In addition, from the viewpoint of facilitating production of the compound with an industrially useful yield, the mass ratio of the cis isomer to the trans isomer (cis isomer: trans isomer) is preferably from 98:2 to 60:40 and more preferably from 98:2 to 90:10. The presence and contents of the cis isomer and the trans isomer may be determined and measured, for example, by NMR and/or gas chromatography.

[Process for Producing Alicyclic Ester]

The alicyclic ester of the present invention may be produced through the following reaction formula (A) by the method described in "Canadian Journal of Chemistry", Vol. 74, pp. 2487-2502 (1996).

(A)

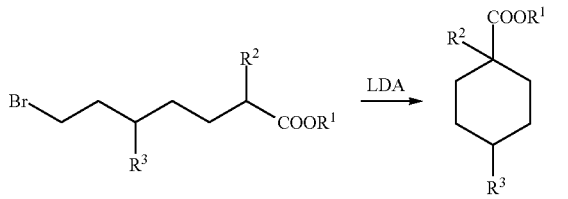

wherein LDA is lithium isopropyl amide.

The alicyclic ester of the present invention may also be produced through the following reaction formula (B) in which an aldehyde is oxidized with an oxidizing agent to obtain a carboxylic acid, and then the thus obtained carboxylic acid is esterified with $R^1OH$.

(B)

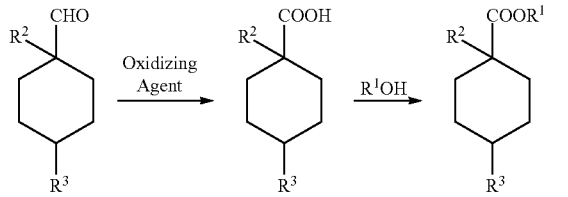

In addition, the alicyclic ester of the present invention in which $R^2$ is a methyl group and $R^3$ is an isopropyl group may also be produced by the method described in "Izvestiya Akademii Nauk SSSR, Seriya Khimicheskaya", Vol. 4, pp. 841-847 (1979).

Meanwhile, in each of the above reaction formulae (A) and (B), $R^1$, $R^2$ and $R^3$ all are the same as those defined in the above general formula (I).

The alicyclic ester of the present invention exhibits a fruity odor having a peculiar fresh woody, floral or grassy-leafy nuance, and is excellent in persistency of the fragrance. Therefore, the alicyclic esters may be used singly or in combination with other components as aromatizing ingredients for soaps, shampoos, rinses, detergents, cosmetics, spray products, aromatic agents, perfumes and bath agents.

[Perfume Composition]

The perfume composition of the present invention contains the alicyclic ester represented by the general formula (I), and is obtained by compounding a single kind or two or more kinds of the alicyclic esters represented by the above general formula (I) with other ordinary perfume components or perfume preparations having a desired composition.

The amount of the alicyclic ester compounded in the perfume composition varies depending upon kind of the perfume preparation, kind of odor as aimed, intensity of the odor, etc., and may be appropriately determined. The content of the alicyclic ester in the perfume composition is preferably from 0.01 to 100% by mass, more preferably from 0.1 to 90% by mass and still more preferably from 0.1 to 50% by mass.

Examples of the other perfume components that may be used in combination with the alicyclic ester in the perfume composition of the present invention include hydrocarbons, alcohols, phenols, esters, carbonates, aldehydes, ketones, acetals, ethers, nitriles, carboxylic acids, lactones, and natural essential oils or natural extracts.

Specific examples of the hydrocarbons include limonene, α-pinene, β-pinene, terpinene, cedrene, longifolene and valencene.

Specific examples of the alcohols include linalol, citronellol, geraniol, nerol, terpineol, dihydromyrcenol, ethyl linalol, farnesol, nerolidol, cis-3-hexenol, cedrol, menthol, borneol, phenylethyl alcohol, benzyl alcohol, dimethylbenzyl carbinol, phenylethyldimethyl carbinol, phenyl hexanol, 2,2,6-trimethylcyclohexyl-3-hexanol and "AMBER CORE" (tradename; available from Kao Corp.).

Specific examples of the phenols include guaiacol, eugenol, isoeugenol, thymol, p-cresol and vanillin.

Examples of the esters include formic acid esters, acetic acid esters, propionic acid esters, butyric acid esters, nonenoic acid esters, benzoic acid esters, cinnamic acid esters, salicylic acid esters, brassilic acid esters, tiglic acid esters, jasmonic acid esters, glycidic acid esters and anthranllic acid esters.

Specific examples of the formic acid esters include linalyl formate, citronellyl formate and geranyl formate. Specific examples of the acetic acid esters include hexyl acetate, cis-3-hexenyl acetate, linalyl acetate, citronellyl acetate, geranyl acetate, neryl acetate, terpinyl acetate, nonyl acetate, bornyl acetate, isobornyl acetate, o-tert-butylcyclohexyl acetate, p-tert-butylcyclohexyl acetate, tricyclodecenyl acetate, benzyl acetate, phenylethyl acetate, styralyl acetate, cinnamyl acetate, dimethylbenzylcarbinyl acetate, phenylethylphenyl acetate, 3-pentyl tetrahydropyran-4-yl acetate and p-cresylphenyl acetate. Specific examples of the propionic acid esters include citronellyl propionate, tricyclodecenyl propionate, allylcyclohexyl propionate, ethyl 2-cyclohexyl propionate and benzyl propionate. Specific examples of the butyric acid esters include citronellyl butyrate, ethyl 2-methyl butyrate, dimethylbenzylcarbinyl butyrate and tricyclodecenyl butyrate.

Specific examples of the nonenoic acid esters include methyl 2-nonenoate, ethyl 2-nonenoate and ethyl 3-nonenoate. Specific examples of the benzoic acid esters include methyl benzoate, benzyl benzoate and 3,6-dimethyl benzoate. Specific examples of the cinnamic acid esters include methyl cinnamate and benzyl cinnamate. Specific examples of the salicylic acid esters include methyl salicylate and n-hexyl salicylate, cis-3-hexenyl salicylate, cyclohexyl salicylate and benzyl salicylate.

Specific examples of the brassilic acid esters include ethylene brassilate. Specific examples of the tiglic acid esters include geranyl tiglate, 1-hexyl tiglate and cis-3-hexenyl tiglate. Specific examples of the jasmonic acid esters include methyl jasmonate and methyl dihydrojasmonate. Specific examples of the glycidic acid esters include methyl 2,4-dihydroxy-ethylmethylphenyl glycidate and 4-methylphenylethyl glycidate. Specific examples of the anthranilic acid esters include methyl anthranilate, ethyl anthranilate and dimethyl anthranilate.

Specific examples of the carbonates include "JASMACYCLAT" (tradename; available from Kao Corp.) and "FLORAMAT" (tradename; available from Kao Corp.).

Specific examples of the other esters include "PERANAT" (tradename; available from Kao Corp.), "FRUITATE" (tradename; available from Kao Corp.), "MELUSAT" (tradename; available from Kao Corp.) and "POIRENATE" (tradename; available from Kao Corp.).

Specific examples of the aldehydes include n-octanal, n-nonanal, n-decanal, n-dodecanal, 2-methyl undecanal, 10-undecenal, citronellal, citral, hydroxycitronellal, benzaldehyde, phenyl acetaldehyde, phenylpropyl aldehyde, cinnamaldehyde, dimethyl tetrahydrobenzaldehyde, "Lyral" (tradename; available from IFF), 2-cyclohexyl propanal, p-tert-butyl-α-methyl hydrocinnamaldehyde, p-isopropyl-α-methyl hydrocinnamaldehyde, p-ethyl-α,α-dimethyl hydrocinnamaldehyde, α-amyl cinnamaldehyde, α-hexyl cinnamaldehyde, heliotropin, α-methyl-3,4-methylenedioxy hydrocinnamaldehyde and "POLLENAL II" (tradename; available from Kao Corp.).

Specific examples of the ketones include α-ionone, β-ionone, γ-ionone, α-methyl ionone, β-methyl ionone, γ-methyl ionone, damascenone, methyl heptenone, 4-methyl-3,5,6,6-tetramethyl-2-heptanone, amyl cyclopentanone, dihydrojasmone, rose ketone, carvone, menthone, camphor, acetyl cedrene, isolongifolanone, nootkatone, benzyl acetone, anisyl acetone, methyl (3-naphthyl ketone, 2,5-dimethyl-4-hydroxy-3(2H)-furanone, maltol, muscone, civetone and cyclopentadecanone.

Specific examples of the acetals include acetaldehyde ethylphenylpropyl acetal, citral diethyl acetal, phenyl acetaldehyde glycerol acetal, ethyl acetoacetate ethylene glycol acetal and "BOISAMBRENE FORTE" (tradename; available from Kao Corp.).

Specific examples of the ethers include cedryl methyl ether, anethole, β-naphthyl methyl ether, β-naphthyl ethyl ether, limonene oxide, rose oxide, nerol oxide, 1,8-cineole, rose furan, "AMBROXAN" (tradename; available from Kao Corp.) and "HERBAVERT" (tradename; available from Kao Corp.).

Specific examples of the nitriles include geranyl nitrile, citronellyl nitrile and dodecane nitrile.

Specific examples of the carboxylic acids include benzoic acid, phenylacetic acid, cinnamic acid, hydrocinnamic acid, butyric acid and 2-hexenoic acid.

Specific examples of the lactones include γ-decalactone, δ-decalactone, γ-valerolactone, γ-nonalactone, γ-undecalactone, δ-hexalactone, γ-jasmolactone, whisky lactone, coumarin, cyclopentadecanolide, cyclohexadecanolide, ambrettolide, 11-oxahexadecanolide and butylidene phthalide.

Examples of the natural essential oils or natural extracts include orange, lemon, lime, bergamot, vanilla, mandarine, peppermint, spearmint, lavender, camomile, rosemary, eucalyptus, sage, basil, rose, rockrose, geranium, jasmine, ylang ylang, anise, clove, ginger, nutmeg, cardamom, cedar, cypress, vetyver, patchouli, lemongrass and labdanum.

EXAMPLES

Example 1

A flask was charged with 10 g of 4-isopropyl-1-methyl cyclohexane carbaldehyde, 200 mL of tert-butanol and 100 mL of 2-methyl-2-butene. While stirring the contents of the flask, a solution prepared by dissolving 13 g of sodium chlorite and 11 g of sodium dihydrogenphosphate in 80 mL of water was added to the flask at 0° C. After stirring the contents of the flask at room temperature for 40 min, a part of tert-butanol in the flask was distilled off, and then a small amount of sulfuric acid was added to the flask. The resulting reaction mixture was extracted with an ether, and the thus obtained extract solution was concentrated and then purified by a silica gel column, thereby obtaining 11 g of 4-isopropyl-1-methyl cyclohexanecarboxylic acid.

A flask equipped with a reflux device was charged with 5 g of the thus obtained 4-isopropyl-1-methyl cyclohexanecarboxylic acid, 60 mL of ethanol and 1.5 mL of sulfuric acid, and then the contents of the flask were refluxed for 34 h. After distilling off ethanol from the resulting reaction mixture, an aqueous sodium hydroxide solution was added thereto, and the mixture was extracted with ethyl acetate. The resulting extract solution was concentrated and purified by a silica gel column, thereby obtaining 3 g of ethyl 4-isopropyl-1-methyl cyclohexanecarboxylate [ratio (mass ratio) of cis isomer to trans isomer (cis:trans)=92:8)], The resulting reaction product was further separated into the respective isomers by a silica gel column or a gas chromatograph, thereby obtaining ethyl cis-4-isopropyl-1-methyl cyclohexanecarboxylate and ethyl trans-4-isopropyl-1-methyl cyclohexanecarboxylate.

The structure and content of the thus obtained ethyl cis- or trans-4-isopropyl-1-methyl cyclohexanecarboxylate were identified and measured by nuclear magnetic resonance spectrum ($^1$H-NMR) and gas chromatography, respectively. The nuclear magnetic resonance spectrum was measured by "Mercury 400" available from Variant Inc., using chloroform-d as a solvent.

Ethyl cis-4-isopropyl-1-methyl cyclohexanecarboxylate $^1$H-NMR ($CDCl_3$, 400 MHz, δ ppm): 0.83 (d, J=6.4 Hz, 6H), 0.96-1.11 (m, 5H), 1.12 (s, 3H), 1.17 (s, 3H), 1.25 (t, J=6.8 Hz, 3H), 1.35-1.39 (m, 1H), 1.60 (br d, J=8.0 Hz, 2H), 2.21 (br d, J=14.0 Hz, 2H), 4.13 (q, J=6.8 Hz, 2H)

$^{13}$C-NMR ($CDCl_3$, 100 MHz, δ ppm): 14.7 ($CH_3$), 20.3 ($CH_3$), 27.6 ($CH_2$), 28.8 ($CH_3$), 33.1 (CH), 36.5 ($CH_2$), 43.8 (C), 43.8 (CH), 60.4 ($CH_2$), 177.4 (C)

Odor: light fruity, woody, green grassy-leafy odor

Ethyl trans-4-isopropyl-1-methyl cyclohexanecarboxylate $^1$H-NMR ($CDCl_3$, 400 MHz, δ ppm): 0.87 (d, J=6.8 Hz, 6H), 0.97-1.06 (m, 1H), 1.12-1.20 (m, 2H), 1.17 (s, 3H), 1.24

(t, J=6.8 Hz, 3H), 1.40-1.48 (m, 1H), 1.54-1.60 (m, 2H), 1.64-1.68 (m, 4H), 4.11 (q, J=6.8 Hz, 2H)

$^{13}$C-NMR ($CDCl_3$, 100 MHz, δ ppm): 14.7 ($CH_3$), 20.3 ($CH_3$), 20.6 ($CH_3$), 25.1 ($CH_2$), 32.7 (CH), 34.2 ($CH_2$), 42.1 (C), 43.8 (CH), 60.5 ($CH_2$), 179.1 (C)

Odor: sweet strong fruity, woody, green grassy-leafy odor

Example 2

A flask equipped with a reflux device was charged with 4 g of 4-isopropyl-1-methyl cyclohexanecarboxylic acid obtained at the first half stage of Example 1, 50 mL of methanol and 1 mL of sulfuric acid, and then the contents of the flask were refluxed for 29 h. After distilling off methanol from the resulting reaction mixture, methylene chloride and sodium hydrogencarbonate were added thereto. The resulting reaction mixture was subjected to filtration, drying and concentration and then purified by a silica gel column, thereby obtaining 3 g of methyl 4-isopropyl-1-methyl cyclohexanecarboxylate [ratio of cis isomer to trans isomer (cis:trans)=97:3)].

Methyl 4-isopropyl-1-methyl cyclohexanecarboxylate (a mixture containing the cis isomer and the trans isomer at a ratio of 97:3):

$^{1}$H-NMR ($CDCl_3$, 400 MHz, δ ppm; main signals detected from the cis-trans mixture): 0.83 (d, Hz), 0.87 (d, J=6.8 Hz), 0.96-1.11 (m), 1.13 (s), 1.18 (s), 1.21-1.48 (m), 1.59-1.65 (m), 2.20 (br d), 3.67 (s)

$^{13}$C-NMR ($CDCl_3$, 100 MHz, δ ppm; main signals detected from the cis-trans mixture): 20.0, 27.3, 28.4, 32.8, 36.2, 43.5, 43.7, 51.6, 117.6

Odor: Fresh floral, fruity, green grassy-leafy odor

Example 3

The ethyl 4-isopropyl-1-methyl cyclohexanecarboxylate [ratio (mass ratio) of cis isomer to trans isomer (cis:trans)=92:8)] obtained in Example 1 was compounded with the other components as shown in Table 1 to prepare a perfume composition. Meanwhile, the amounts of the respective components compounded as shown in Table 1 represent part(s) by mass (this definition is similarly applied to the subsequent descriptions).

Comparative Example 1

The same procedure as in Example 3 was repeated except for using 40 parts by mass of dipropylene glycol in place of 40 parts by mass of ethyl 4-isopropyl-1-methyl cyclohexanecarboxylate [ratio (mass ratio) of cis isomer to trans isomer (cis:trans)=92:8)] obtained in Example 1, thereby producing a perfume composition.

TABLE 1

| Perfume composition (part(s) by mass) | Example 3 | Comparative Example 1 |
|---|---|---|
| "PERANAT" (tradename; available from Kao Corp.) | | 25 |
| Cis-3-hexenol | 50 | 50 |
| Hexyl acetate | 150 | 150 |
| "Liffarome" (tradename; available from IFF) | 50 | 50 |
| "POLLENAL II" (tradename; available from Kao Corp.) | 100 | 100 |
| Ethyl 2-methyl butyrate | 100 | 100 |

TABLE 1-continued

| Perfume composition (part(s) by mass) | Example 3 | Comparative Example 1 |
|---|---|---|
| "POIRENATE"(tradename; available from Kao Corp.) | 150 | 150 |
| γ-Undecalactone | 150 | 150 |
| "MELUSAT" (tradename; available from Kao Corp.) | 100 | 100 |
| Nerolidol | 75 | 75 |
| "JASMACYCLAT" (tradename; available from Kao Corp.) | 10 | 10 |
| Dipropylene glycol | 0 | 40 |
| Ethyl 4-isopropyl-1-methyl cyclohexanecarboxylate (cis:trans = 92:8) | 40 | 0 |
| Total | 1000 | 1000 |

The perfume composition obtained in Example 3 in which the ethyl 4-isopropyl-1-methyl cyclohexanecarboxylate [ratio (mass ratio) of cis isomer to trans isomer (cis:trans)=92:8)] obtained in Example 1 was compounded, had an excellent odor, i.e., an emphasized pear-like juicy sweet odor reminiscent of a fruit flesh sense, as compared to the perfume composition having a fruity note of scent obtained in Comparative Example 1.

Example 4

The methyl 4-isopropyl-1-methyl cyclohexanecarboxylate [ratio (mass ratio) of cis isomer to trans isomer (cis:trans)=97:3)] obtained in Example 2 was compounded with the other components as shown in Table 2 to prepare a perfume composition.

Comparative Example 2

The same procedure as in Example 4 was repeated except for using 30 parts by mass of dipropylene glycol in place of 30 parts by mass of methyl 4-isopropyl-1-methyl cyclohexanecarboxylate [ratio (mass ratio) of cis isomer to trans isomer (cis:trans)=97:3)] obtained in Example 2, thereby producing a perfume composition.

TABLE 2

| Perfume composition (part(s) by mass) | Example 4 | Comparative Example 2 |
|---|---|---|
| "PERANAT" (tradename; available from Kao Corp.) | 30 | 30 |
| "POLLENAL II" (tradename; available from Kao Corp.) | 6 | 6 |
| "MELUSAT" (tradename; available from Kao Corp.) | 60 | 60 |
| "JASMACYCLAT" (tradename; available from Kao Corp.) | 0.3 | 0.3 |
| "AMBER CORE" (tradename; available from Kao Corp.) | 30 | 30 |
| Methyl dihydrojasmonate | 60 | 60 |
| Limonene | 651.7 | 651.7 |
| "FLORAMAT" (tradename; available from Kao Corp.) | 60 | 60 |
| Thymol | 30 | 30 |
| Dimethyl anthranilate | 12 | 12 |
| Cyclohexyl salicylate (tradename; available from Kao Corp.) | 30 | 30 |

TABLE 2-continued

| Perfume composition (part(s) by mass) | Example 4 | Comparative Example 2 |
|---|---|---|
| Dipropylene glycol | 0 | 30 |
| Methyl 4-isopropyl-1-methyl cyclohexanecarboxylate (cis:trans = 97:3) | 30 | 0 |
| Total | 1000 | 1000 |

The perfume composition obtained in Example 4 in which the methyl 4-isopropyl-1-methyl cyclohexanecarboxylate [ratio (mass ratio) of cis isomer to trans isomer (cis:trans)=97:3)] obtained in Example 2 was compounded, had an excellent citrus green note of scent, i.e., an emphasized fresh juicy citrus odor reminiscent of a "yuzu", a kind of a citron fruit odor, as compared to the perfume composition having a citrus green note of scent obtained in Comparative Example 2.

Industrial Applicability

The perfume composition of the present invention is imparted with a sophisticated note of scent by incorporating the alicyclic ester of the present invention therein, and therefore can be suitably used as an aromatizing ingredient for toiletry goods such as soaps, shampoos, rinses, detergents, cosmetics, spray products, aromatic agents, perfumes and bath agents., etc.

The invention claimed is:

1. A perfume composition comprising a compound represented by formula (I):

(I)

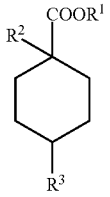

wherein $R^1$ is a methyl group or an ethyl group; $R^2$ is a methyl group; and $R^3$ is an isopropyl group.

2. The perfume composition according to claim 1, wherein the compound represented by formula (I) comprises a cis isomer and a trans isomer in which a steric configuration of the $COOR^1$ group and the $R^3$ group is a cis type and a trans type, respectively, such that a mass ratio of the cis isomer to the trans isomer (cis isomer: trans isomer) is from 99:1 to 0:100.

3. The perfume composition according to claim 1, wherein $R^1$ is a methyl group.

4. The perfume composition according to claim 1, wherein $R^1$ is an ethyl group.

5. The perfume composition according to claim 1, wherein the composition is a fruity perfume material.

6. The perfume composition according to claim 1, wherein said compound represented by formula (I) is present in said perfume composition in an amount of from 0.01 to 100% by mass.

7. The perfume composition according to claim 1, wherein said compound represented by formula (I) is present in said perfume composition in an amount of from 0.1 to 90% by mass.

8. The perfume composition according to claim 1, further comprising at least one additional perfume component selected from the group consisting of a hydrocarbon, an alcohol, a phenol, an ester, a carbonate, an aldehyde, a ketone, an acetal, an ether, a nitrile, a carboxylic acid, a lactone, a natural essential oil and a natural extract.

9. A method of making a perfume, comprising, adding at least one compound represented by formula (I)

(I)

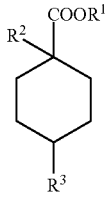

to a composition, to form a perfume composition, wherein $R^1$ is a methyl group or an ethyl group; $R^2$ is a methyl group; and $R^3$ is an isopropyl group.

10. A method according to claim 9, wherein the compound represented by formula (I) comprises a cis isomer and a trans isomer in which a steric configuration of the $COOR^1$ group and the $R^3$ group is a cis type and a trans type, respectively, such that a mass ratio of the cis isomer to the trans isomer (cis isomer:trans isomer) is from 99:1 to 0:100.

11. A method according to claim 10, wherein the mass ratio of the cis isomer to the trans isomer (cis isomer:trans isomer) is 98:2 to 60:40.

12. A method according to claim 10, wherein the mass ratio of the cis isomer to the trans isomer (cis isomer:trans isomer) is 98:2 to 90:10.

13. A method according to claim 9, wherein said compound represented by formula (I) is present in said perfume composition in an amount of from 0.01 to 100% by mass.

14. A method according to claim 9, wherein said compound represented by formula (I) is present in said perfume composition in an amount of from 0.1 to 90% by mass.

15. A method according to claim 9, wherein said compound represented by formula (I) is present in said perfume composition in an amount of from 0.1 to 50% by mass.

16. A method of perfuming an object, comprising applying a perfume composition comprising a compound represented by formula (I)

(I)

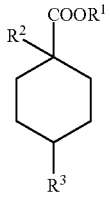

to said object, wherein $R^1$ is a methyl group or an ethyl group; $R^2$ is a methyl group; and $R^3$ is an isopropyl group.

* * * * *